United States Patent [19]

Welcher et al.

[11] 4,050,393

[45] Sept. 27, 1977

[54] METHOD AND APPARATUS FOR CONTROLLING AN AUTOMATIC BAR TACKING MACHINE

[75] Inventors: Ray E. Welcher, Danvers; Roger E. Lemay, Beverly, both of Mass.

[73] Assignee: USM Corporation, Boston, Mass.

[21] Appl. No.: 617,445

[22] Filed: Sept. 29, 1975

[51] Int. Cl.[2] ..... D05B 21/00

[52] U.S. Cl. ..... 112/121.12

[58] Field of Search ..... 112/121.12, 121.11, 112/158 E; 340/172.5; 235/151.11; 318/567, 569

[56] References Cited

U.S. PATENT DOCUMENTS

| | | | |
|---|---|---|---|
| 3,742,879 | 7/1973 | Schaefer, Jr. | 112/121.12 |
| 3,820,082 | 6/1974 | Bauknecht | 340/172.5 |
| 3,830,175 | 8/1974 | Levor | 112/121.12 |
| 3,855,956 | 12/1974 | Wurst | 112/158 E |
| 3,982,491 | 9/1976 | Herzer et al. | 112/121.12 |

*Primary Examiner*—Werner H. Schroeder
*Assistant Examiner*—Peter Nerbun
*Attorney, Agent, or Firm*—William F. White; Richard B. Megley; Vincent A. White

[57] ABSTRACT

This invention relates to an automatic sewing machine in which the workpiece is moved under the sewing head by means of a clamp which is driven by stepping motors along two coordinate axis through a predetermined pattern. The stepping motors are connected to the workpiece clamp through a non-linear linkage assembly. The stepping motors are controlled by a coded Programmable Read Only Memory (PROM) which generates signals in timed relation to the operation of the sewing machine. The PROM is coded by first digitizing the stitch coordinates of the predetermined pattern and then modifying each of the coordinate values to compensate for the non-linearity of the linkage system.

3 Claims, 18 Drawing Figures

X & Y DIRECTION
X & Y AXIS STEP COUNTERS 104 & 105
MACH CONTROL
103
BIT7
BIT6
BIT5
BIT4
BIT3
BIT2
BIT1
BIT8
FROM OSC 101
INVERT
TO PROM ADDRESS LINES
114
115
CARRY SN74193
+5V
102
RESET
PROM READ OSC

METHOD AND APPARATUS FOR CONTROLLING AN AUTOMATIC BAR TACKING MACHINE

BACKGROUND OF THE INVENTION

Bar tacking is the term used to describe the sewing of small stitch patterns which are generally used for reinforcing joints in shoes and other garments. These patterns are generally limited to a specific number of stitches in the range of from 10 to 100 stitches per pattern and cover only a small area of the workpiece. The operation is performed by moving the workpiece under the needle and this motion is achieved automatically by means of a work clamp which is mounted for movement along two axes relative to the needle. Work clamp movement is controlled by a style or feed cam which is operatively linked to the clamp. The style cam is generally driven by means of a shaft connected to the main needle bar drive shaft through a gear train. Thread cutting is controlled by a second can connected to the same shaft but mounted opposite to the style cam. In this manner a limited amount of automatic operation is achieved. However, the variety of patterns are limited by cam design and the gear ratio between the needle drive shaft and the cam shaft since each pattern must be completed within one rotation of the cam. This necessitates the replacement of the style cam for each change in pattern and in addition, if the number of stitches in the pattern changes, a new gear train must be installed. This may require anywhere from two to as long as eight hours effort by a skilled mechanic and results in a significant loss of production per machine.

The purpose of this invention, therefore, is to provide an automatic bar tacker which is free of the restrictions of the style cam, thereby eliminating the need for costly changes resulting in loss of production. This is achieved by the replacement of the style cam with a numerically controlled drive. The mechanics of this drive are described in co-pending U.S. Pat. application Ser. No. 530,048 filed Dec. 5, 1974.

In order to convert the standard bar tacker sewing machine to numerical control, the style and knife cams are removed from their shafft. The knife cam is replaced by a new cam which is operatively connected to its shaft through an electrically operated clutch. The new cam is constructed with additional notches to provide collateral functions such as nipper operation and knife positioning. The vertical operating levers formerly engaging the style cam are fitted with gear sectors and each is operatively connected through a pinion to a stepping motor which is mounted on the sewing machine housing. The stepping motors therefore directly replace the style cam. The stepping motors are controlled by a numerical control system which can be adopted to generate signals to cause movement of the workpiece clamp through the desired tack design and to operate the knife cam clutch and other collateral machine functions.

BRIEF SUMMARY OF THE INVENTION

The workpiece of the automatic bar tacking machine of this invvention is held under the sewing head by means of a clamp which is mounted for movement on the sewing machine along coordinate axis. The workpiece clamp may be driven through a predetermind pattern by stepping motors which are operatively connected to the clamp through a non-linear linkage assembly. In order to drive the stepping motors a control system is provided which consists of a programmable read only memory (PROM) which is coded to generate signals relative to the movement of the workpiece through the predetermined pattern. The PROM operation is actuated by a time delay oscillator which generates timing signals for successive readings of the PROM. Signals from the PROM are transmitted through a decoding circuit to an axis step counter for each stepping motor or to a machine control circuit depending on the PROM signal. The time delay oscillator continues to generate read cycle signals until a step count is received in each axis step counter. The PROM read cycle is then disabled. Machine synchronization pulses are generated by a pulse generator which produces a pulse for each reciprocating movement of the needle. After the initial treadle start by the operator, these signals enable the time delay oscillator. In this manner the read cycle is again initiated.

In order to code the PROM, the coordinates of each stitch in the pattern is digitized to define the path of the workpiece. Each coordinate value of the digitized pattern is then modified to compensate for the nonlinearity of the drive linkage assembly. The PROM therefore is coded to generate signals according to the modified digitized pattern.

DESCRIPTION OF THE DRAWING

This invention is more fully described in conjunction with the appended drawing and in said drawing.

DETAILED DESCRIPTION OF THE PREFERRED EMBODIMENT

Figure 1:
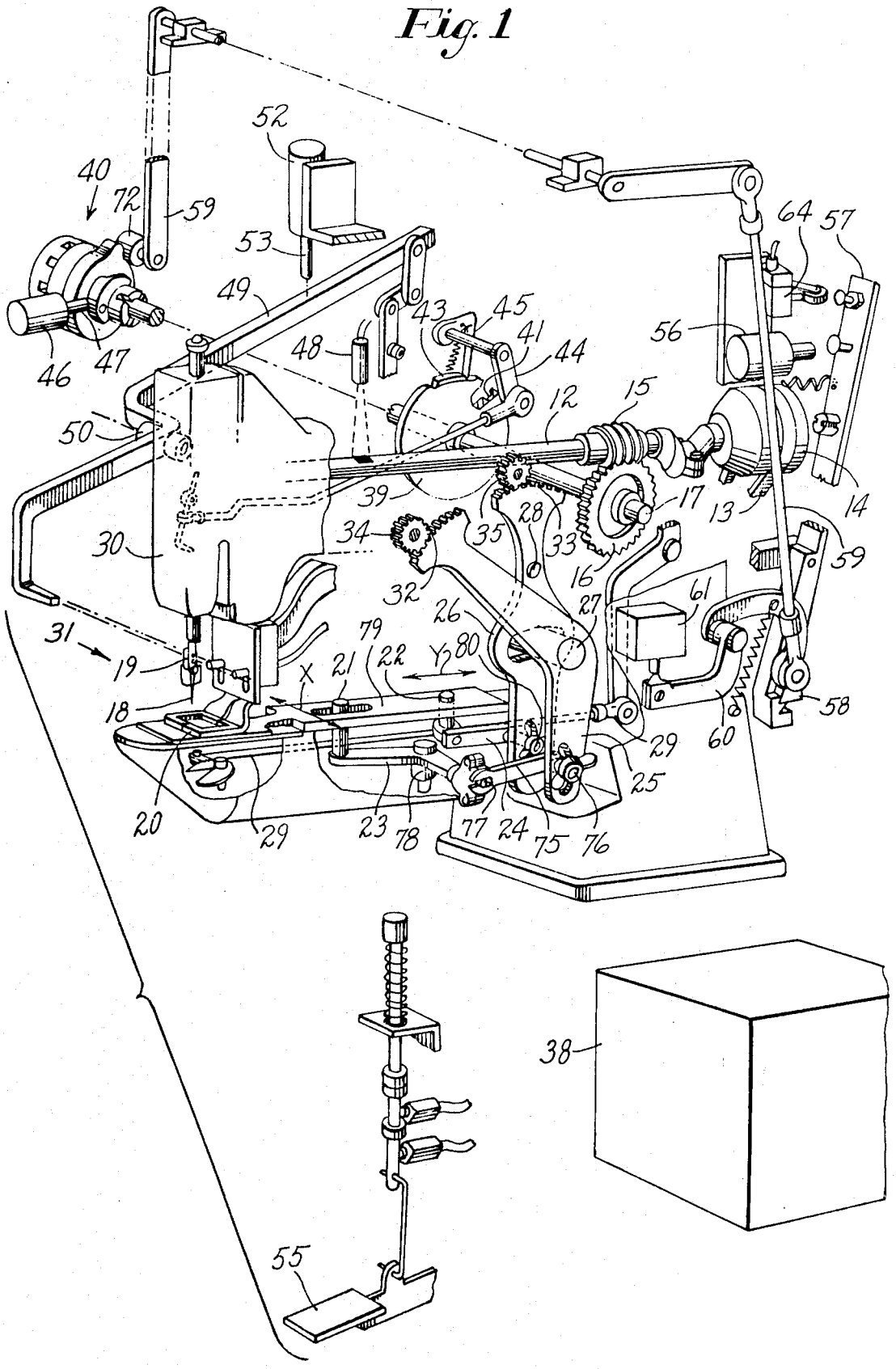
FIG. 1 is a schematic diagram of the bar tacker sewing machine to which the control system is adapted.
Figure 2:
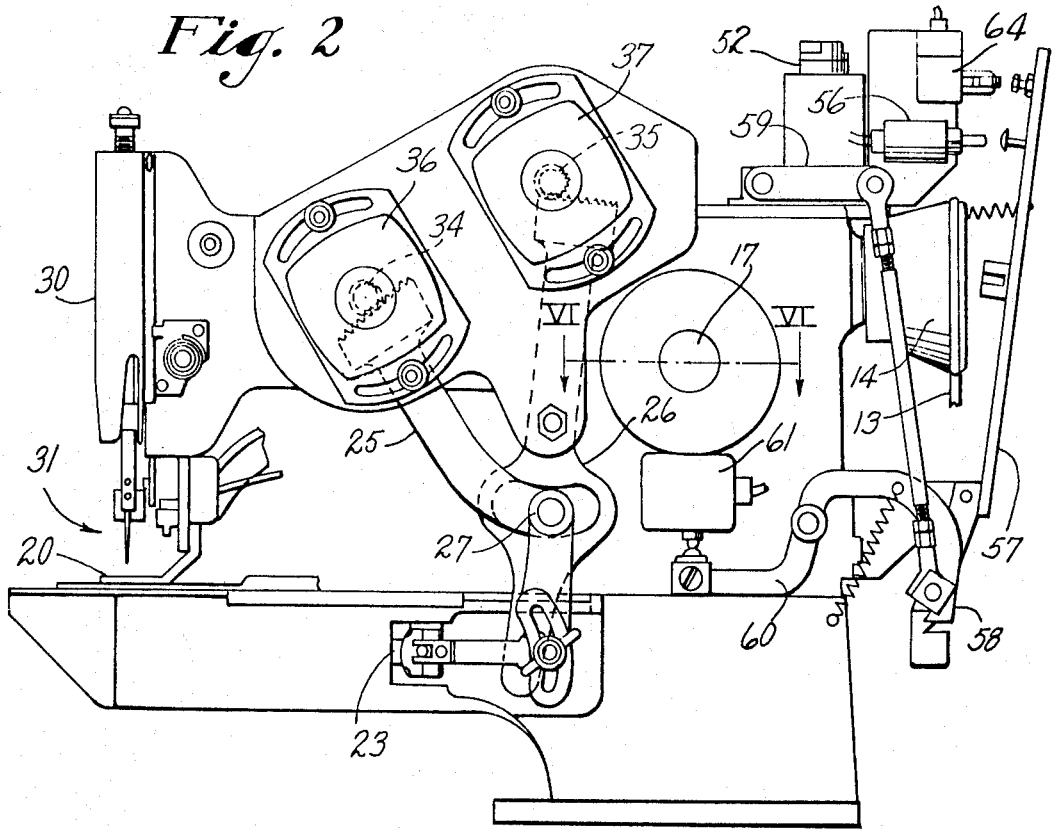
FIG. 2 is a side view of the bar tacker sewing machine utilizing the invention.

The bar tacker sewing machine of this invention is shown in schematic form in FIG. 2. It employs the standard mechanisms, namely, a needle bar drive shaft 12 which is connected to a drive motor (not shown) through belt 13 and clutch 14. Worm gear 15 mounted on the drive shaft 12 engages gear 16 secured to a transverse cam shaft 17. Needle 18 is secured to needle bar 19 which reciprocates during machine operation. A work clamp 20 is provided which is mounted for pivotal and sliding movement on the machine. Linkages 23 and 24 connect the work clamp 20 to operation levers 25 and 26 respectively. As shown, lever 25 is connected to work clamp 20 at point 21 and movement thereof causes movement of the work clamp along the X axis, while lever 26 is connected to clamp 20 at point 22 and movement thereof causes movement of the work clamp along the Y axis. The operation levers 25 and 26 are mounted for pivotal movement at points 27 and 28 respectively. A knife mechanism 29 is provided for cutting the thread and a nipper bar 30 is mounted in the sewing head 31 to hold the thread during cutting and during the initial part of the stitching operation to prevent the thread from pulling out of the needle.

Figure 3:
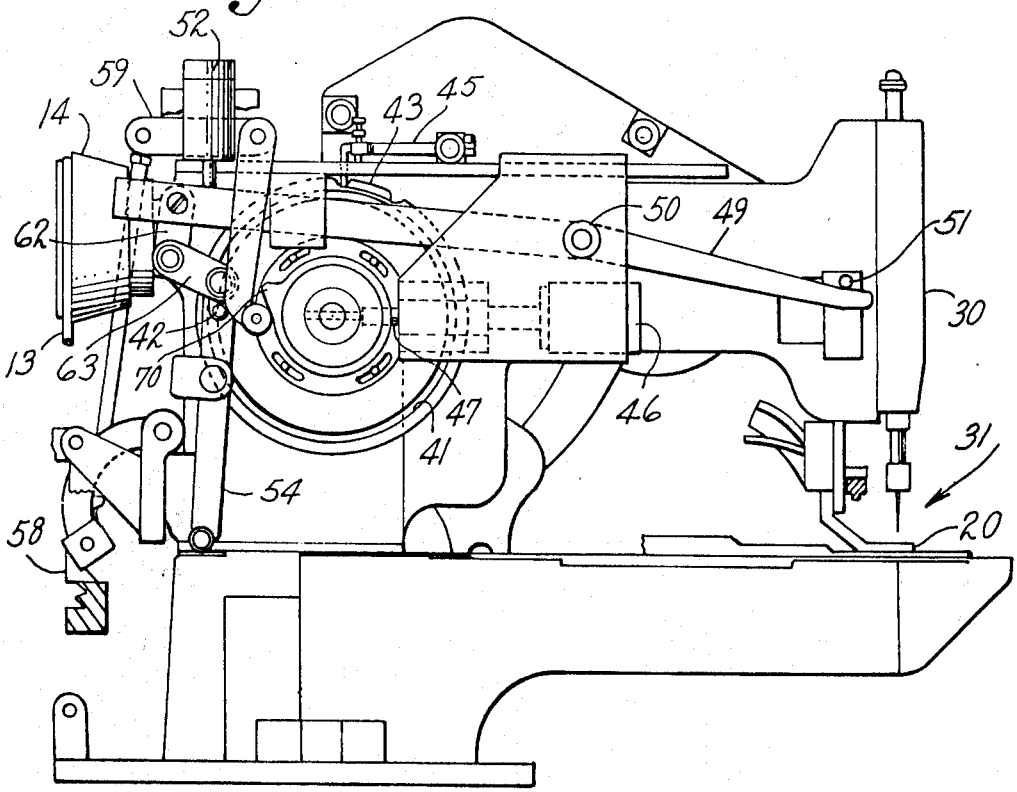
FIG. 3 is a side view of the knife cam side of a bar tacker sewing machine incorporating this invention.

In order to provide motion for the work clamp 20, the operation levers 25 and 26 have gear sectors 32 and 33 fixed to the upper end of the lever arms. The gear sectors 32 and 33 mesh with pattern drive gears 34 and 35. The gears 34 and 35 are driven by stepping motors 36 and 37 as shown in FIG. 3. Each of the stepping motors is constructed to respond with a specific degree off rotary motion for each drive pulse it receives. In order to generate the drive signal, a digital control 38 is provided which generates the pulses necessary to cause movement of the workpiece through a predetermined tack pattern. It is this control system which forms the basis of this invention and is described in detail below.

Figure 4:
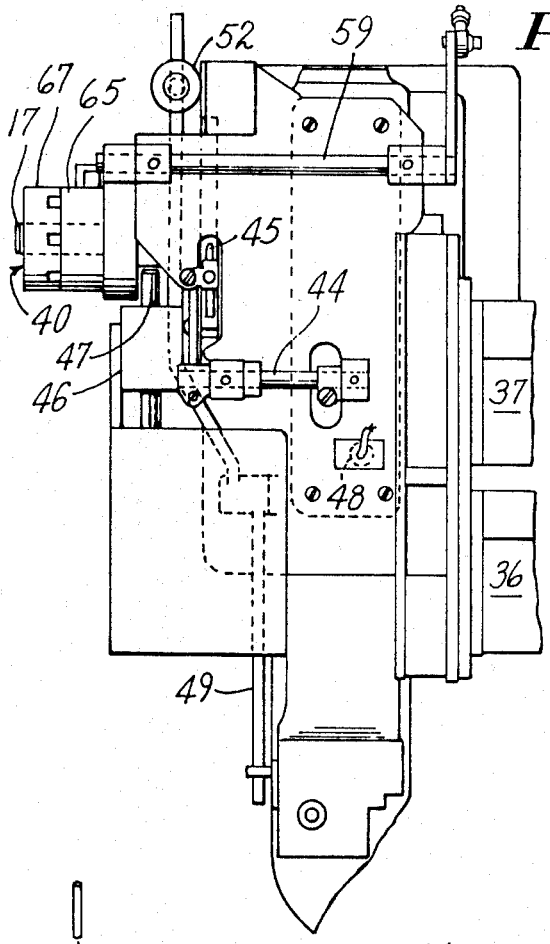
FIG. 4 is a top view of a bar tacker sewing machine incorporating the invention.

A knife cam 39 is mounted for free rotation on cam shaft 17, and is releasably coupled to shaft 17 through clutch 40. When clutch 40 is engaged, the cam 39 turns with the cam shaft 17 which is in turn driven by drive shaft 12 through gears 15 and 16. As shown in FIG. 4, the knife cam 39 is constructed with a track 41 which receives a follower 42 connected to the cutting mechanism 29 through follower arm 54. The rotating knife cam 39, therefore, provides motion for the positioning of cutting mechanism 29 according to a design which is well known in the art. The actual cutting stroke is provided by air cylinder 52 as described below. By adjusting the ratio between worm gear 15 and gear 16, the complete cutting operation may be performed within the period of a few stitches and at other times the cam may be at rest through disengagement of clutch 40. The absence of the style cam and the clutching of the knife cam eliminate the restrictions formerly limiting the number of stitches which could be performed in a tack pattern because the pattern and the cutting operation need no longer be completed within one revolution of the cams.

Operation of nipper bar 30 may also be provided by knife cam 39 through an additional cam surface 43 on the circumference of knife cam 39. To accomplish this, the bar 30 is connected through linkage 44 to follower 45 in a known manner as shown in FIG. 5.

In order to operate clutch 40, an electrical solenoid 46 is mounted on the sewing machine and has a shaft 47 extending therefrom. The shaft 47 moves from a withdrawn position to an extended position upon energization of the solenoid. In the extended position, the shaft 47 engages a surface of the clutch causing release of the clutch 40 and locking of the cam 39. The solenoid 46 may be energized by a signal from control 38 which can be programmed to occur at any desirable point in the stitch cycle. As shown in the timing diagram of FIG. 8, in the preferred embodiment, the clutch is disengaged after the fifth stitch and engaged again before the third stitch from the end off the cycle.

Figure 5:
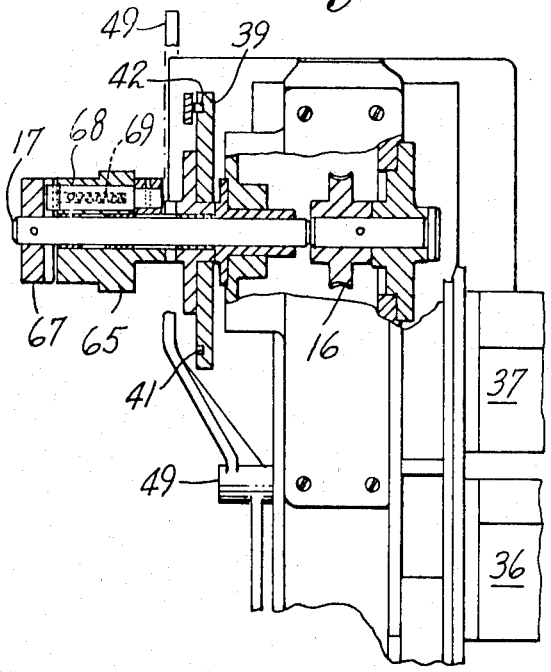
FIG. 5 is a top view of a bar tacker sewing machine incorporating the invention with housing cut away to show the cam shaft.
Figure 6:
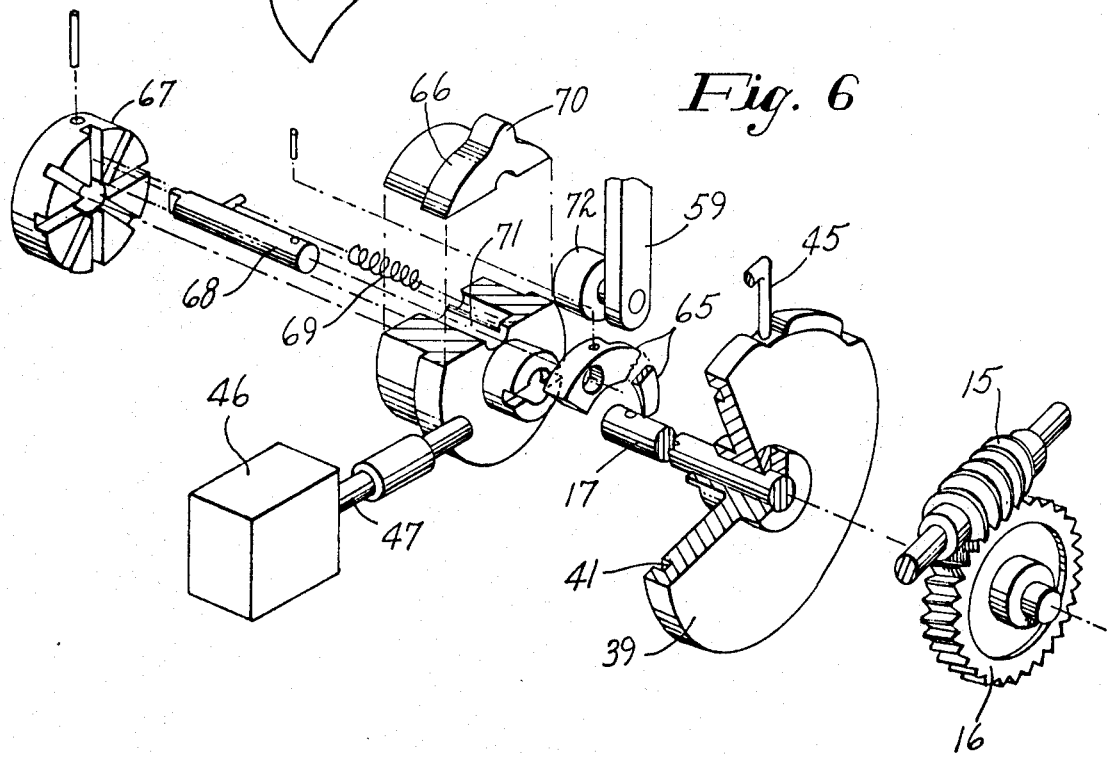
FIG. 6 is an exploded perspective view of a clutch as used in the preferred embodiment.
Figure 7:
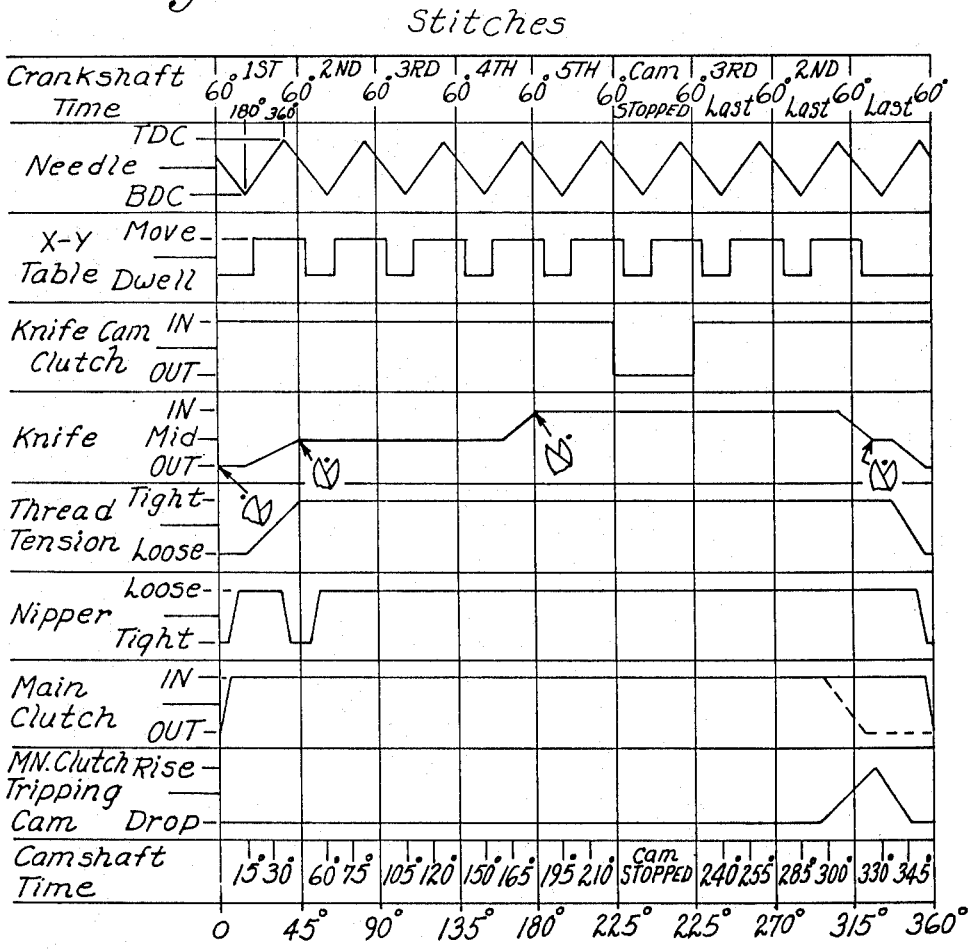
FIG. 7 is a timing diagram of the functioning of the machine.

Clutch 40 is best shown if FIG. 7 and consists of a collar 66 coupled to knife cam 39 and mounted for free rotation on cam shaft 17 (see FIG. 5 and 6). A locking pin 68 slides in bore 71 and is spring biased away from cam 39 by spring 69. Notched hub 67 is fixed to cam shaft 17 and receives pin 68 in locking engagement when pin 68 is in its extended position. Pin 68 extends through bore 71 and is fixed to cam surface 65. In operation to release the clutch, solenoid 46 is energized extending shaft 47. Shaft 47 engages cam surface 65 and forces surface 65 away from collar 66, thereby withdrawing locking pin 68 from engagement with the notches of collar 67.

In order to allow the control 38 to keep track of the number of stitches performed during a specific tack pattern, a magnetic pulse generator 48 is provided which sends a synchronizing pulse to the control 38 for each rotation of drive shaft 12. This may be accomplished simply by mounting a magnetic element on shaft 12 and placing a magnetic sensing head on the machine housing. A pulse is induced in the sensing head for each passing of the magnet.

At the end of the stitching operation, it is desirable to cut the thread and release the workpiece from its clamp. To provide this function, a lever arm 49 is pivotally mounted on the sewing machine at point 50. As best shown in FIG. 4, the forward end of lever arm 49 engages a lifting mechanism 51 in the sewing head 31. The mechanism 51 causes the jaws of the work clamp 20 to separate as the forward end of lever arm 49 pivots upward. This upward movement is caused by air cylinder 52, the piston rod 53 of which engages the rear end of lever arm 49. When the piston rod 53 extends upon actuation of the cylinder 52, the lever arm 49 pivots to open the jaws of the work clamp 20. The rearward end of lever arm 49 is linked by pivotal members 62 and 63 to follower arm 54 which in turn is connected to the knife mechanism 29. The downward motion of the rear end of lever 49 caused by extension of piston rod 53 actuates the cutting stroke of the knife.

OPERATION

Operation of the machine is started by the manual depression of a treadle 55 which actuates air cylinder 56 and forces lever 57 to pivot away from the machine thereby engaging ratchet 58 to lock in this position. This motion simultaneously causes the engagement of drive shaft 12 to the drive motor through clutch 14 and actuates air valve 64 to cause retraction of piston rod 53 to clamp the workpiece. Engagement of ratchet 58 causes lever 60 to rotate, thereby actuating microswitch 61. The switch 61 in turn energizes control 38. As soon as control 38 receives timing pulses from pulse generator 48, it begins to send its programmed signals to stepping motore 36 and 37, thereby causing movement of the workpiece according to the predetermined pattern. At the end of the fifth stitch, control 38 generates a signal which actuates solenoid 46 to disengage clutch 40 and lock cam 39 against rotation. Cam 39, therefore, does not rotate during the major portion of the tack pattern and is only engaged again at the beginning of the third stitch from the end of the pattern.

Figure 8:
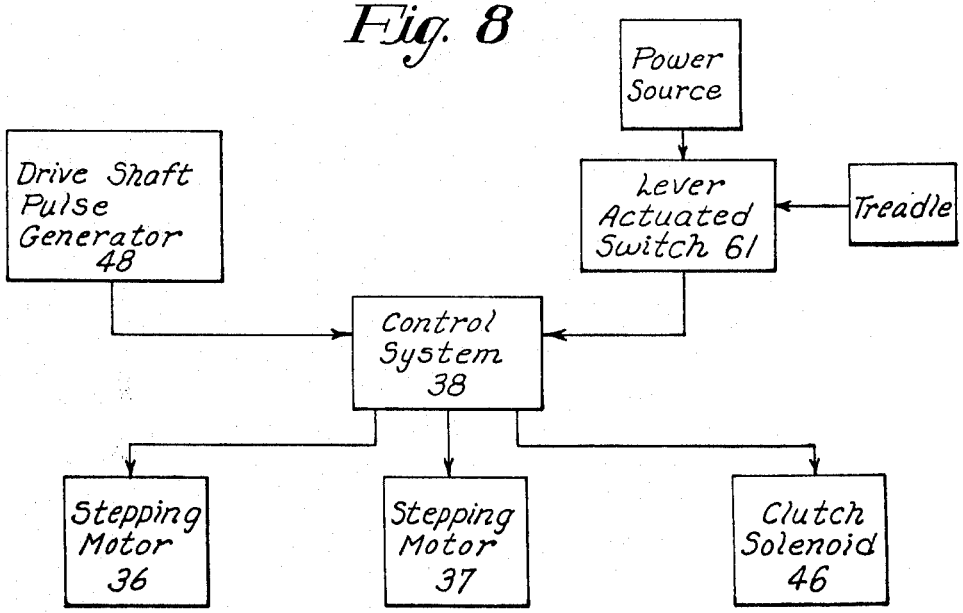
FIG. 8 is a block diagram showing the flow of information to and from the control system.
Figure 9:
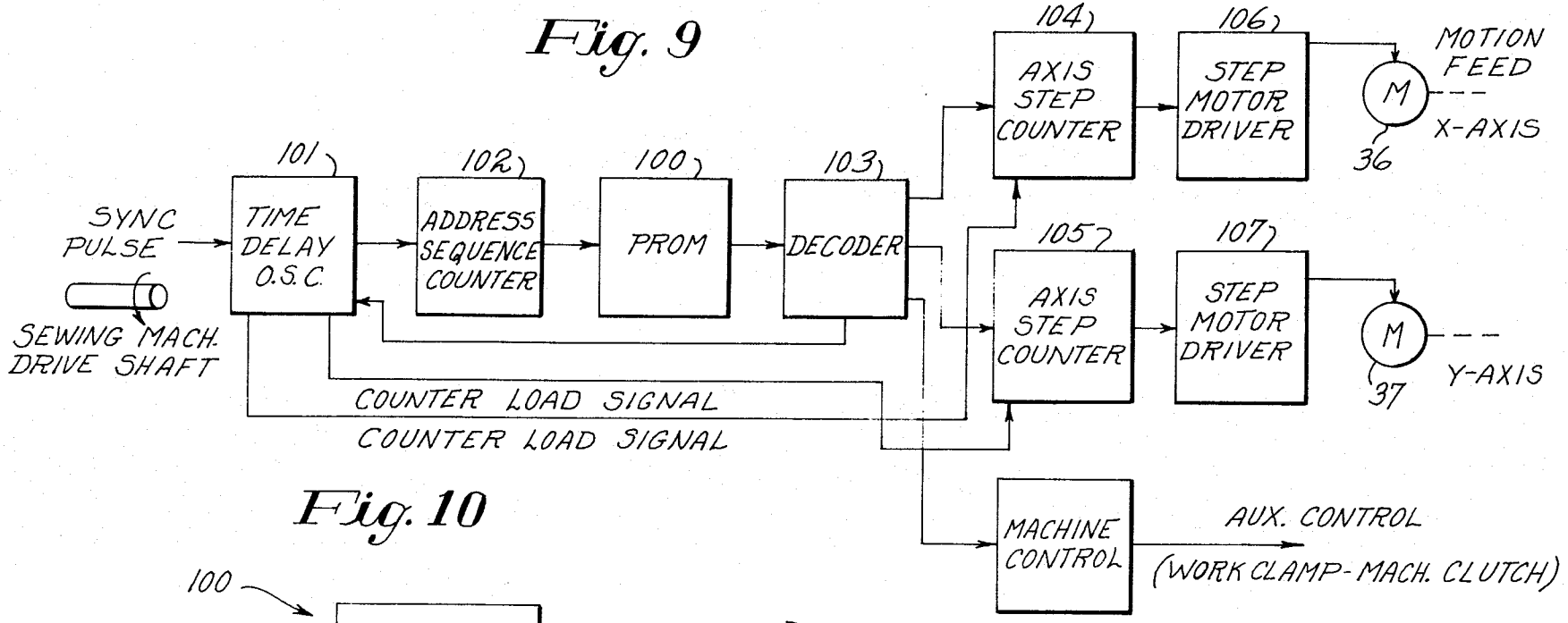
FIG. 9 is a block diagram of the control system.

At the end of the tack pattern, the knife cam will have rotated a full turn thereby causing the knife position to move as indicated in FIG. 8 placing the knife in position for the cutting stroke. Again referring to FIG. 8, it is observed that the nipper bar is also actuated at the end of the cycle and this timed by knife cam 39. In order to stop the machine and initiate the cutting stroke, a lobe 70 is constructed on clutch collar 66 for engagement with a follower 72 which transmits motion to lever system 59. As the follower 72 rides over lobe 70, lever system 59 releases the ratchet 58 causing lever 57 to return thereby disengaging main drive clutch 14. Release of ratchet 58 also causes lever 60 to deactuate switch 61 which shuts off control system 38. The return of lever 57 also causes valve 58 to actuate air cylinder 52 which initiates the cutting stroke.

Figure 10:
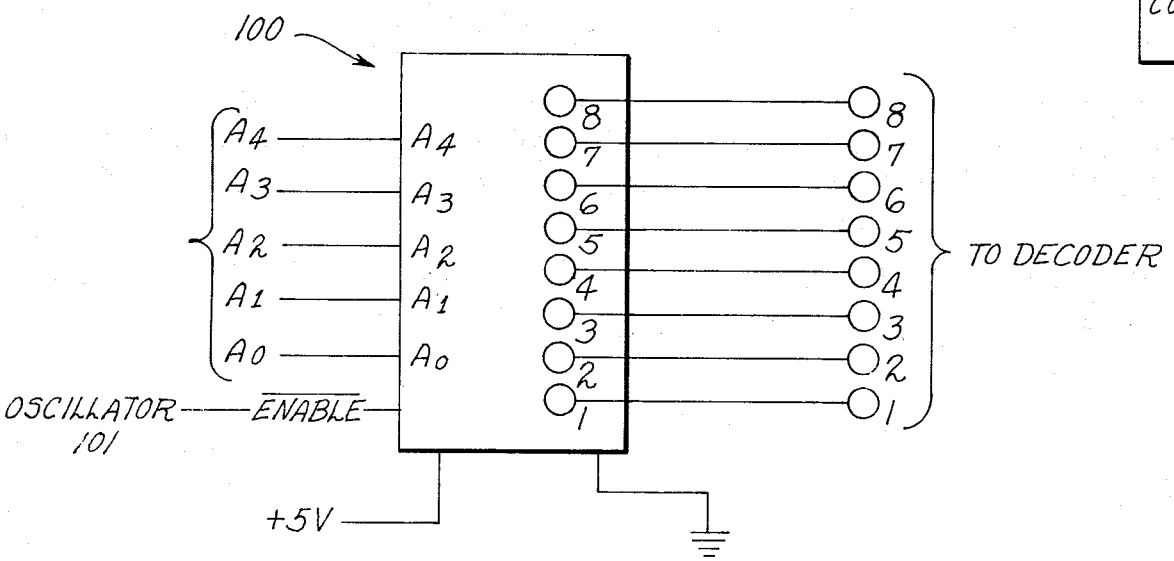
FIG. 10 is a diagram of a PROM.

The control system 38 is shown in detail in FIG. 10. In order to provide complete control of all machine functions, the system 38 must provide drive signals to cause the stepping motors 36 and 37 to move through discrete rotary steps which are proportional to the distance along each coordinate axis between each stitch location. In addition, the system 38 must initiate the collateral functions such as engaging and disengaging the drive clutch, unclamping, nipping, and thread cutting at certain periods of the sewing cycle. The collateral functions of nipping and cutting are basically run by the cam 39 and, therefore, a timed signal to the clutch solenoid 46 will accomplish these functions. The main drive clutch 14 is energized by a timed signal from control 38. This system therefore basically generates machine control signals and x-y coordinate data signals.

As shown in FIG. 10 the basic building block of the control system 38 is a Programmable Read Only Memory (PROM) 100. This device may be coded to generate both control signals to actuate the collateral function cam 39 and the main drive motor and x-y coordinate data signals for driving the stepping motors 36 and 37. Each signal is contained in progressive addresses in the PROM and may be triggered or read by a timed signal to the PROM.

The basic PROM read cycle is initiated by a signal from a time delay oscillator 101 which sends read signals to the PROM until both x-y coordinate data signals are generated. The read signals are timed at intervals which allow sufficient time for PROM operation and insure that the control and data signals are generated for each stitch, well within the period of needle retraction.

In order to proceed through the pattern, which is coded into PROM 100 in progressive addresses, a sequence counter 102 is inserted to receive the read signals and transmit such signals to the PROM 100. In this manner, the data signals from each address of the PROM 100 are obtained. In order to decipher between data signals and control signals, a decoding circuit 103 receives the signals from the PROM 100 and transmits them to the stepping motor drivers 106 and 107 or machine control components such as solenoid 46. The time delay oscillator 101 also receives signals from the decoding circuit 103 in order to determine when the data signals are complete.

Each motor driver 106 and 107 receives signals through axis step counters 104 and 105 respectively, These counters sum the number of steps to be taken by each motor and then count down as signals from the motor drivers 106 and 107 indicate a step is completed.

As was discussed before, the time delay oscillator 101 is disabled when the data signal is complete for each axis. The next read cycle occurs when the synchronizing pulse from the magnetic pulse generator 48 is received by the oscillator 101.

At the end of the pattern, a control signal will be generated which disengages the main drive clutch 14 and initiates the collateral functions. Oscillator 101 will be disabled until it is energized for the initial read cycle of a new pattern by a switch linked to the treadle 55.

The PROM 100 may be a commercially available 32 word, 8 Bit programmable read only memory such as the Monolithic Memory, Model 6330 which is set up as shown in FIG. 10.

Figure 13:
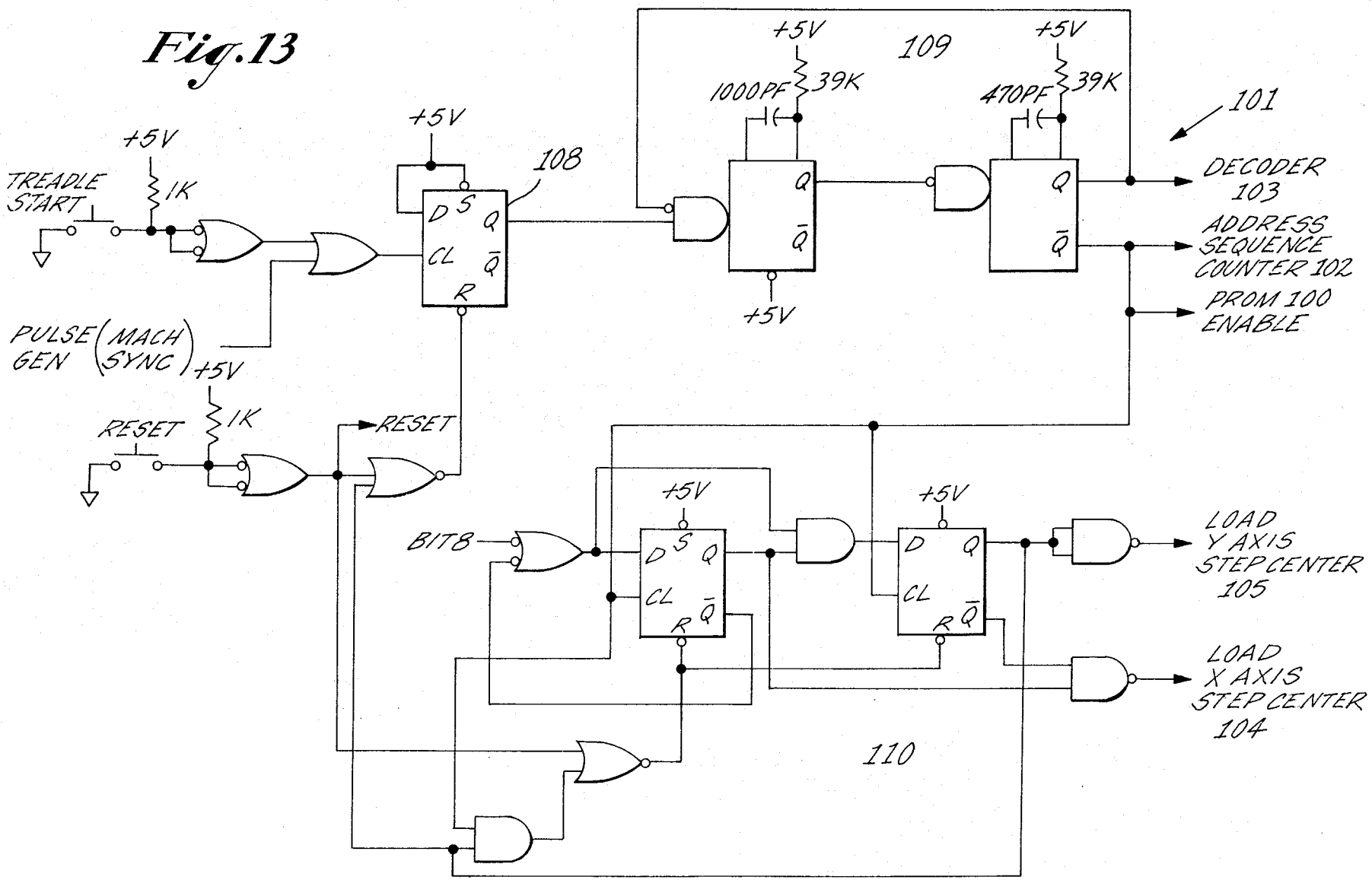
FIG. 13 is a diagram of the time delay oscillator circuit.

The time delay oscillator 101 contains a flip-flop 108 and an oscillator 109 connected as shown in FIG. 13. In addition, the presence of axis data may be registered in a two step counter 110 in order to determine when a complete data signal is generated by the PROM.

Figures 11, 12:
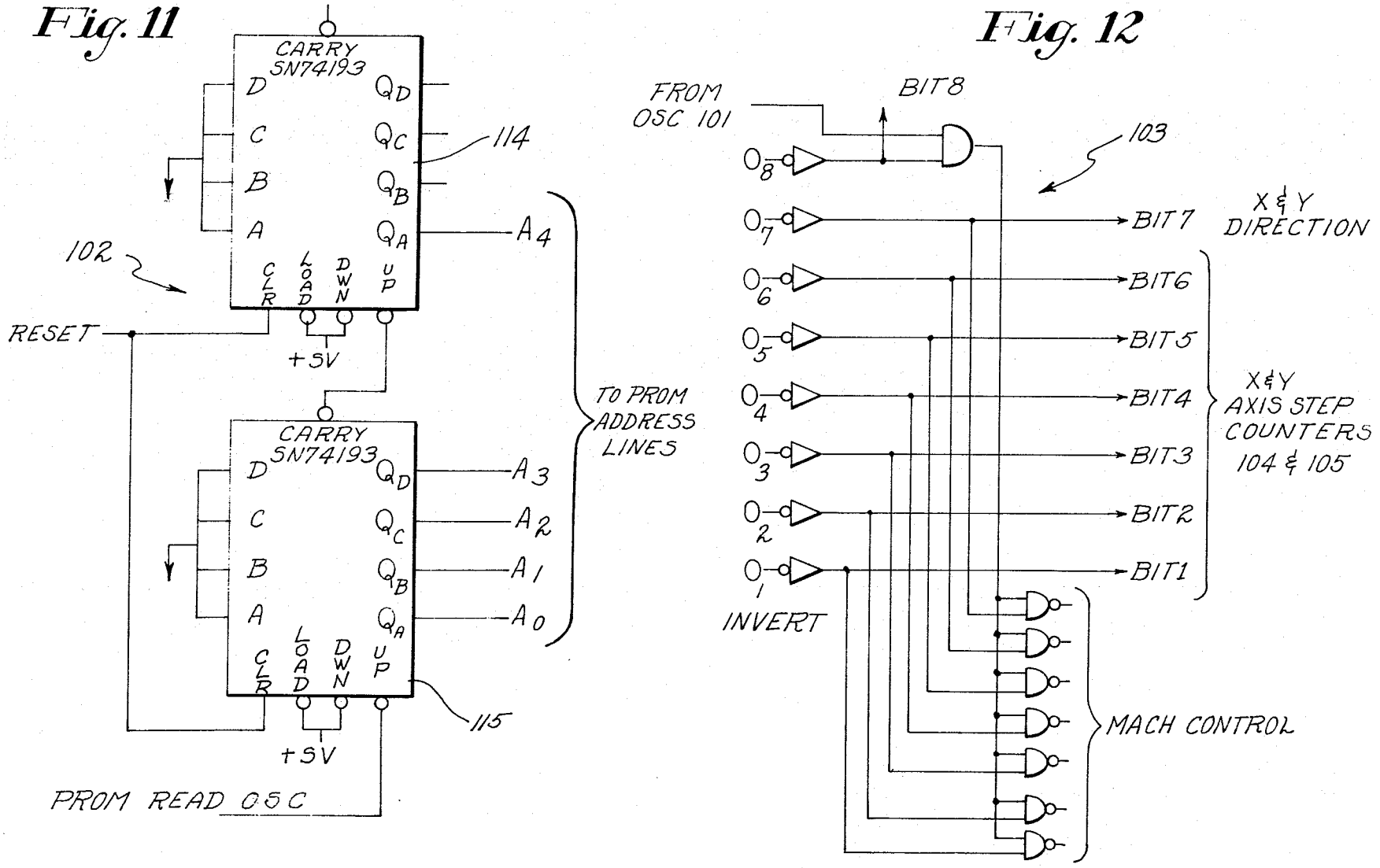
FIG 11 is a diagram of the PROM address sequence counter.
FIG. 12 is a diagram of the decoder.

The address sequence counter 102 can be two counters 114 and 115 connected as shown in FIG. 11. The decoder 103 is a simple gating circuit as shown in FIG. 12.

Figure 14:
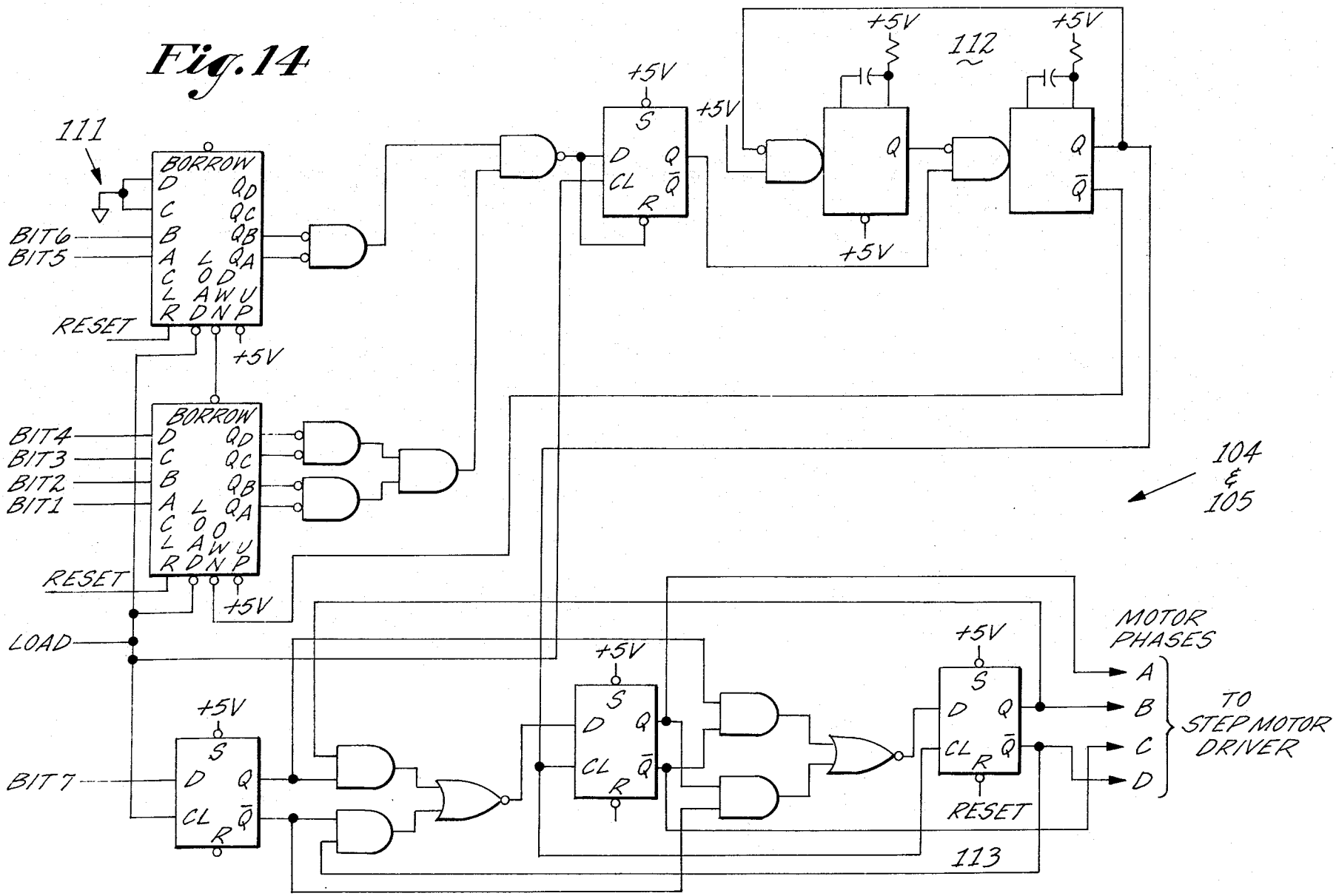
FIG. 14 is a diagram of the axis step counter circuit.

The axis step counters 104 and 105 are identical and each comprise a counter 111, a step oscillator 112 and a motor phase sequencer 113 as shown in FIG. 14. The latter two elements generate the drive signals to the motor drivers.

The stepping motors and drivers may be commercially available units such as those sold by ICON Division of USM Corporation of Cambridge, Massachusetts.

The preparation of a digitized pattern code which reflects the axis coordinates of the location of each stitch relative to the mechanical field of movement of the workpiece is well known. However, in the prior art, the relationship betwen the rotary step of the stepping motor and the movement of the workpiece was generally directly proportional. However, the linkage assembly consisting of links 23 and 24 and levers 25 and 26 do not transmit the rotary motion of stepping motors 36 and 37 in a linear manner. Therefore, the digitized coordinate values must individually be mathematically modified to reflect the functioning of the non-linear linkage assembly and compensate for the errors therein. The PROM 100, therefore, must be coded according to the modified digitized coordinate value.

Figure 15:
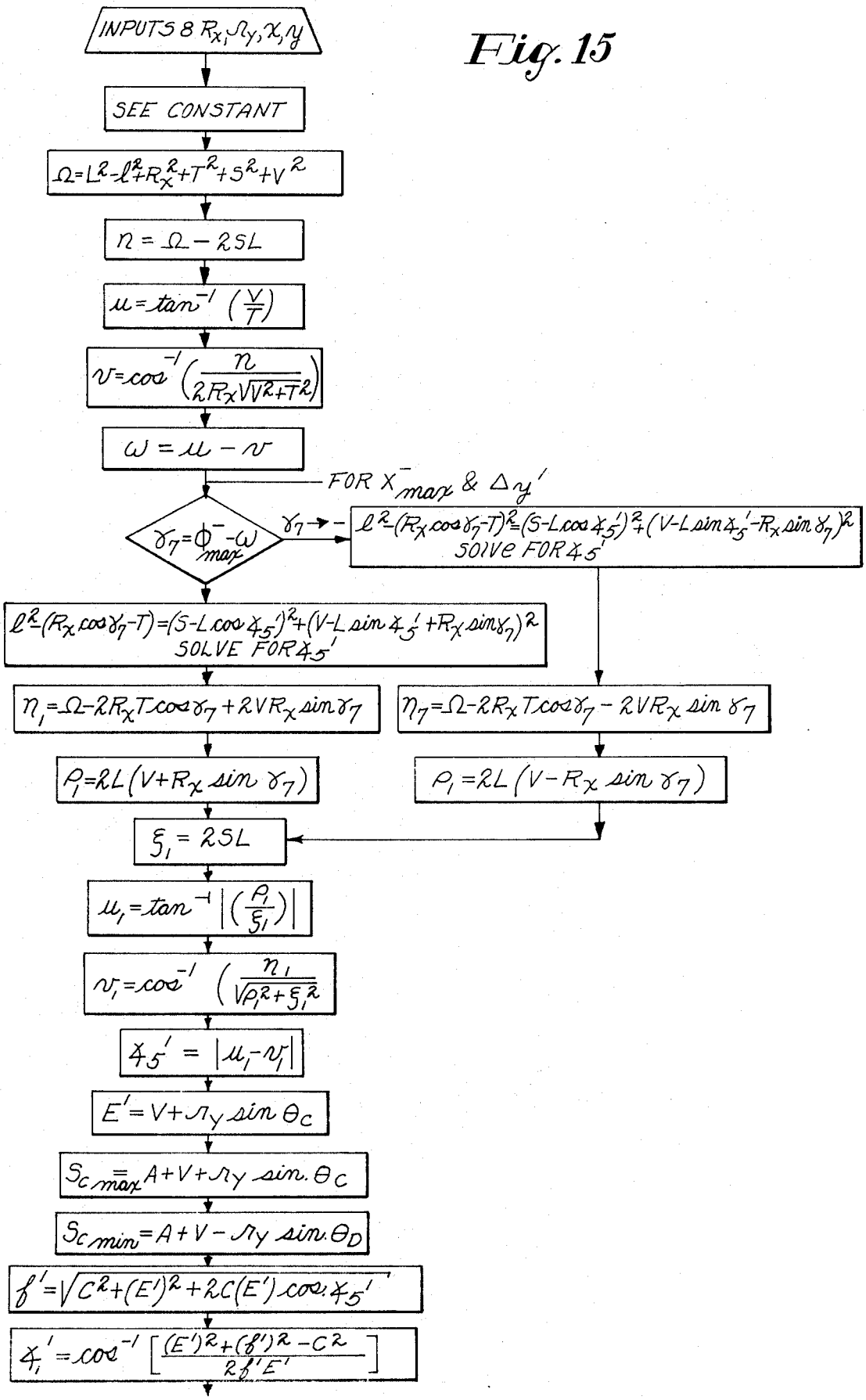
FIG. 15 illustrates typical compensating calculations.
Figure 15A:
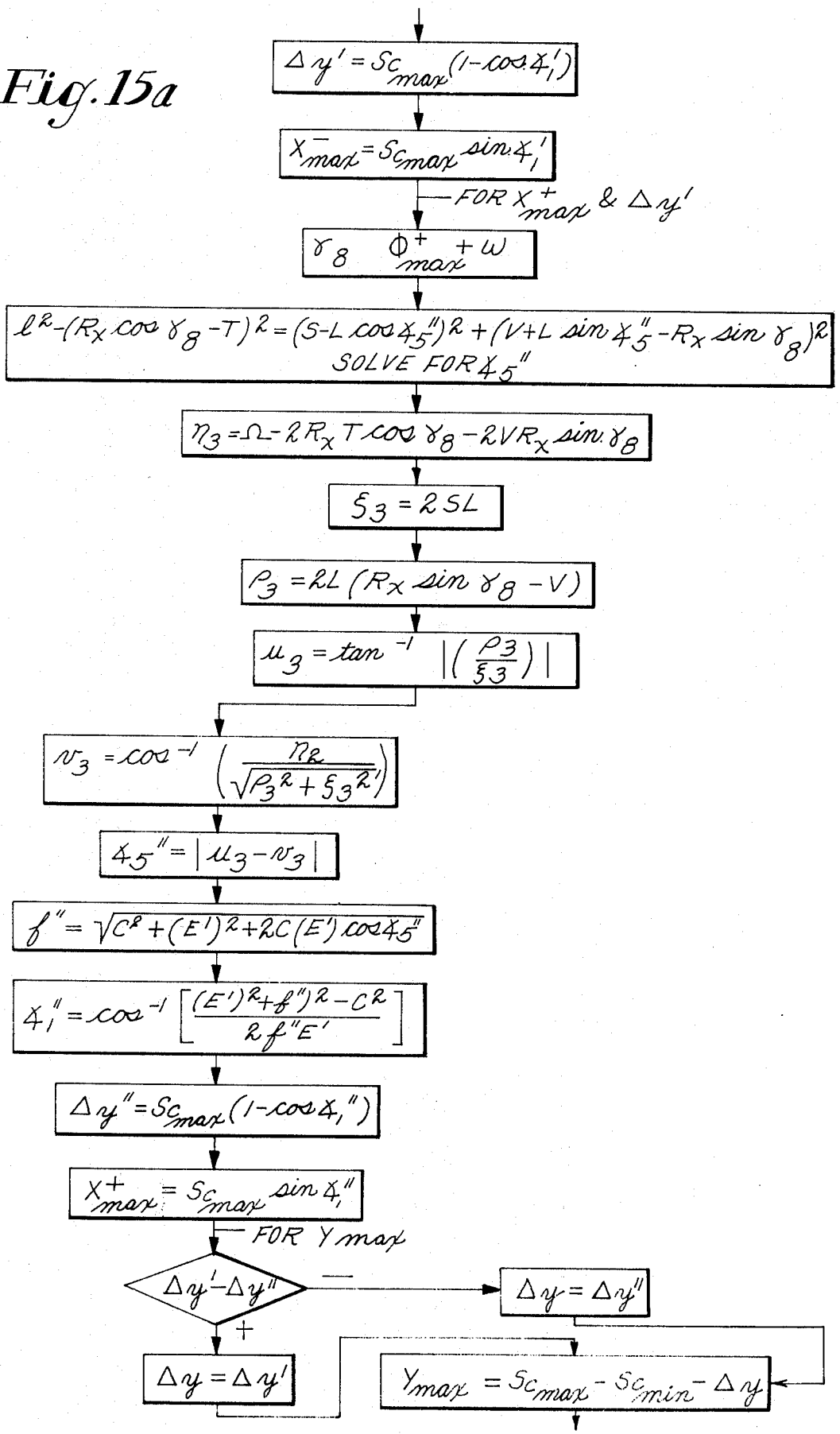
Figure 15B:
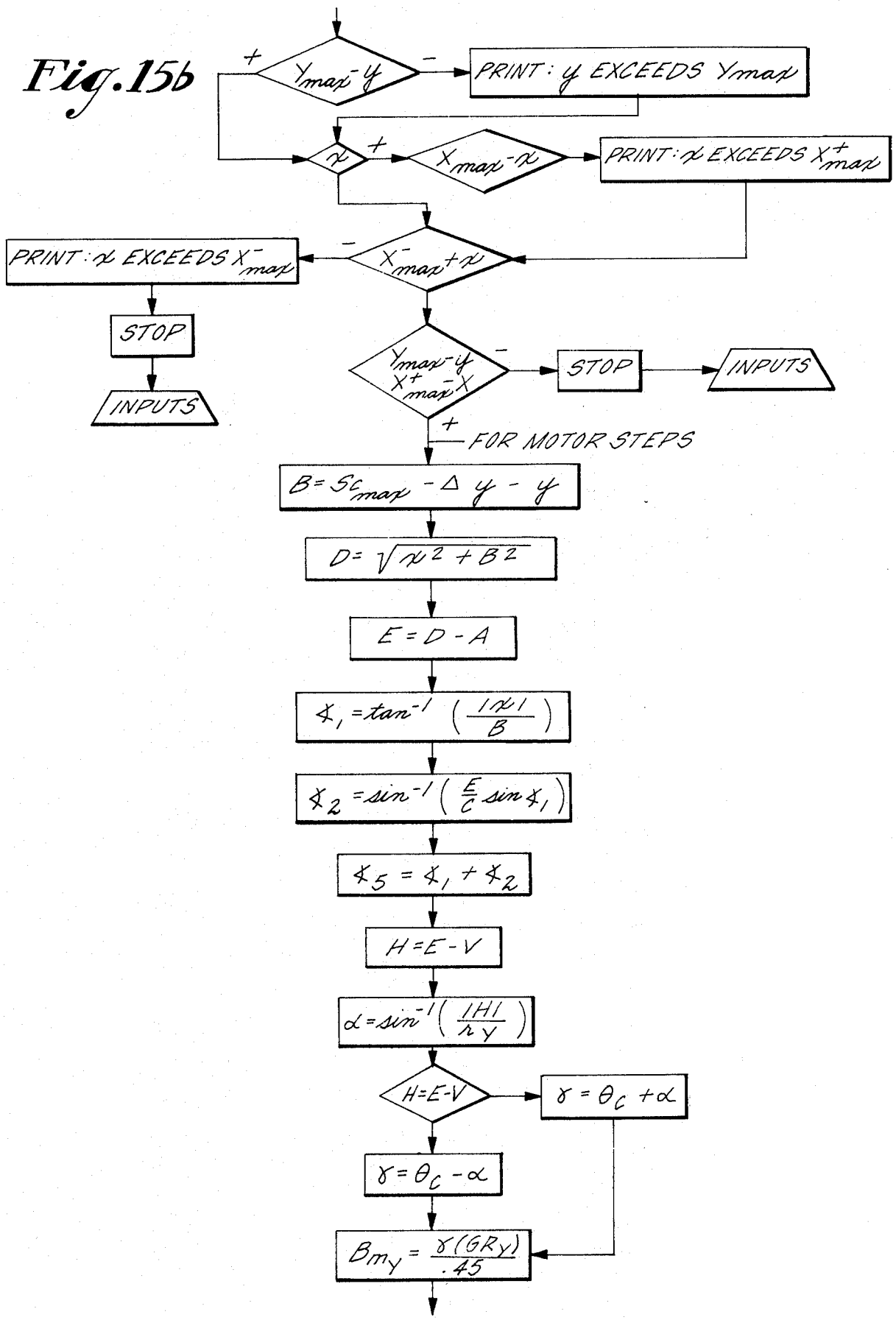
Figure 15C:
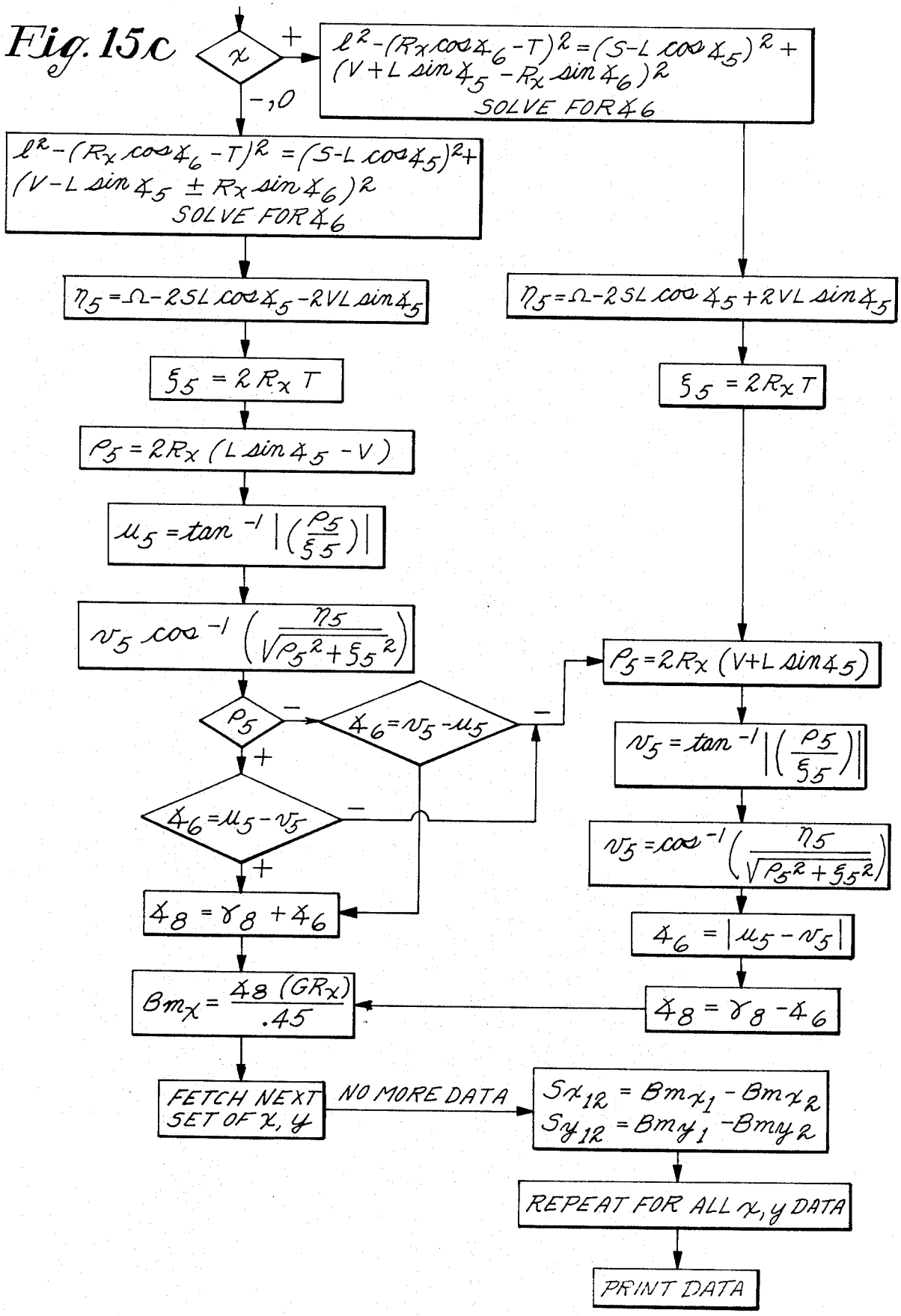

A brief example of the compensating calculation, which may be performed on any general purpose computer, is shown in FIG. 15. These calculations are based on the dimensions and geometrical relationships in the linkage assembly which connects the stepping motors 36 and 37 to the workpiece clamp 20. The linkage assembly consists of lever 25 which pivots at point 27 and lever 26 which pivots at point 28. Lever 25 is connected to crank 23 by means of a link 75. Link 75 pivots about point 76 on lever 25 and point 77 on crank 23. Crank 23 oscillates about an axis through point 78. The main operating clamp plate 79 is operatively connected to crank 23 at point 21. Lever 26 is connected to plate 79 through link 24 which is pivotably connected to lever 26 at point 80 and connected to the plate 79 at point 22. With this linkage assembly in mind, the formula constants are as follows:

Input Variables

Rx: adjustment radius for x axis, the vertical distance between pivot 27 on lever 25 and point 76.

$r_y$: adjustment radius for y axis, the vertical distance between pivot 28 on lever 26 and point 80.

$x$ : output $x$ coordinate.

$y$: output $y$ coordinate.

Program Constants $l$ = length of link 75

$T$ = vertical distance from point 27 to point 77

S = horizontal distance from point 76 to point 78

L = horizontal distance from point 78 to point 77

V = horizontal distance from point 27 to pivot axis of point 78

A = horizontal distance from axis of point 78 to needle

C = length of crank between points 78 and 21

$GR_X$ = gear ratio of $x$ axis $GR_Y$ = gear ratio of $y$ axis $\theta_D$ = maximum angular motion lever 26 towards needle $\theta_c$ = maximum angular motion of lever 26 away from needle $\phi-_{max}$ = maximum angular motion of lever 25 towards needle $\phi+_{max}$ = maximum angular motion of lever 25 away from needle

We claim:

1. In a bar tacking sewing machine having a needle bar drive shaft operatively connected through a clutch to a motor to provide reciprocating motion to a needle, and a workpiece clamp constructed to releasably secure and support a workpiece under the needle, said clamp being slidably and pivotably mounted on the sewing machine for movement relative to the needle along first and second axes, said movement being driven by stepping motors which are operatively connected to the clamp through a non-linear linkage assembly, a method for controlling the stepping motors to provide movement of the workpiece through a predetermined pattern comprising:

A. digitizing the pattern to provide a point by point definition of the path of the workpiece movement;

B. modifying the digitized pattern to compensate for the non-linearity of the clamp drive linkage assembly;

C. coding a Programmable Read Only Memory with the modified digitized pattern;

D. reading the Programmable Read Only Memory by the generation of delayed enabling signals transmitted to said Memory at intervals within the period of needle retraction;

E. generating a train of drive pulses according to the coded digitized pattern;

F. counting each rotation of the needle bar drive shaft and generating timing pulses according thereto; and G. transmitting the drive pulses to the stepping motors in times relation to the timing pulses.

2. In a bar tacking sewing machine having a needle bar drive shaft operatively connected through a clutch to a motor to provide reciprocating motion to a needle, and a workpiece clamp constructed to releasably secure and support a workpiece under the needle, said clamp being slidably and pivotably mounted on the sewing machine for movement relative to the needle along first and second axes, said movement being driven by stepping motors which are operatively connected to the clamp through a non-linear linkage assembly, apparatus for controlling the stepping motors to provide movement of the workpiece through a predetermined pattern comprising:

A. a Programmable Read Only Memory capable of being coded to transmit drive signals to the stepping motors which are indicative of movement of the workpiece clamp through a predetermined pattern, said signals compensating for the non-linearity of the linkage assembly;

B. means for generating a synchronization signal in timed relation to operation of the sewing machine;

C. means responsive to the synchronization signal for generating enabling signals to initiate operation of the Programmable Read Only Memory during the period of needle retraction; and, D. means responsive to the drive signal to register said drive signals and disable the enabling signal generator when said drive signal is complete.

3. In a bar tacking sewing machine having a needle bar drive shaft operatively connected through a clutch to a motor to provide reciprocating motion to a needle, and a workpiece clamp constructed to releasably secure and support a workpiece under the needle, said clamp being slidably and pivotably mounted on the sewing machine for movement relative to the needle along first and second axes, said movement being driven by stepping motors which are operatively connected to the clamp through a non-linear linkage assembly, apparatus for controlling the stepping motors to provide movement of the workpiece through a predetermind pattern as described in claim 2 wherein the programmable read only memory is constructed with a plurality of coded signal transmitting addresses and further comprising means responsive to the enabling signal generator to count each operative cycle of the programmable read only memory and sequence and memory through each of said addresses.

* * * * *

UNITED STATES PATENT OFFICE

CERTIFICATE OF CORRECTION

Patent No. 4,050,393 Dated September 27, 1977

Inventor(s) Ray E. Welcher & Roger E. Lemay

It is certified that error appears in the above-identified patent and that said Letters Patent are hereby corrected as shown below:

Column 7, Cl. 1, Line 30, change the word "times" to-- timed--

Column 8, Cl. 3, Line 18, delete the word "and" second occurrence and insert -- said --.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*